US006394180B1

(12) United States Patent
Berscheidt et al.

(10) Patent No.: US 6,394,180 B1
(45) Date of Patent: May 28, 2002

(54) FRAC PLUG WITH CAGED BALL

(75) Inventors: Kevin T. Berscheidt, Duncan; Donald R. Smith, Wilson; Lee Wayne Stepp, Comanche; Don S. Folds; Gregory W. Vargus, both of Duncan, all of OK (US)

(73) Assignee: Halliburton Energy Service,s Inc., Duncan, OK (US)

( * ) Notice: Subject to any disclaimer, the term of this patent is extended or adjusted under 35 U.S.C. 154(b) by 0 days.

(21) Appl. No.: 09/614,897

(22) Filed: Jul. 12, 2000

(51) Int. Cl.[7] ..... E21B 33/12
(52) U.S. Cl. ..... 166/193; 166/133; 166/135
(58) Field of Search ..... 166/118, 184, 166/131–135, 192, 193, 153, 387

(56) References Cited

U.S. PATENT DOCUMENTS

| | | | | | |
|---|---|---|---|---|---|
| 4,583,593 | A | * | 4/1986 | Zunkel et al. | 166/382 |
| 4,664,188 | A | * | 5/1987 | Zunkel et al. | 166/134 |
| 5,224,540 | A | | 7/1993 | Streich et al. | 166/118 |
| 5,271,468 | A | | 12/1993 | Streich et al. | 166/387 |
| 5,390,737 | A | | 2/1995 | Jacobi et al. | 166/184 |
| 5,540,279 | A | | 7/1996 | Branch et al. | 166/118 |
| 5,701,959 | A | | 12/1997 | Hushbeck et al. | 166/387 |
| 5,839,515 | A | | 11/1998 | Yuan et al. | 166/387 |
| 5,984,007 | A | | 11/1999 | Yuan et al. | 166/134 |
| 6,220,360 | B1 | * | 4/2001 | Connell et al. | 166/373 |

OTHER PUBLICATIONS

Two pages from Halliburton Energy Services Catalog dated Nov. 1999.

* cited by examiner

*Primary Examiner*—David Bagnell
*Assistant Examiner*—Zakiya Walker
(74) *Attorney, Agent, or Firm*—John W. Wustenberg; Anthony L. Rahhal

(57) ABSTRACT

A downhole tool for sealing a wellbore. The downhole tool includes a packer with a ball seat defined therein. A sealing ball is carried with the packer into the well. The movement of the sealing ball away from the ball seat is limited by a ball cage which is attached to the upper end of the packer. The ball cage has a plurality of ports therethrough for allowing flow into the ball cage and through the packer at certain flow rates. A spring is disposed in a longitudinal opening of the packer and engages the sealing ball to prevent the sealing ball from engaging the ball seat until a predetermined flow rate is reached. When the packer is set in the hole, flow through the frac plug below a predetermined flow rate is permitted. Once a predetermined flow rate in the well is reached, a spring force of the spring will be overcome and the sealing ball will engage the ball seat so that no flow through the frac plug is permitted.

13 Claims, 4 Drawing Sheets

FRAC PLUG WITH CAGED BALL

BACKGROUND OF THE INVENTION

This invention relates generally to downhole tools for use in oil and gas wellbores and methods of drilling such apparatus out of wellbores, and more particularly, to such tools having drillable components made from metallic or non-metallic materials, such as soft steel, cast iron, engineering grade plastics and composite materials. This invention relates particularly to downhole packers and frac plugs.

In the drilling or reworking of oil wells, a great variety of downhole tools are used. For example, but not by way of limitation, it is often desirable to seal tubing or other pipe in the casing of the well, such as when it is desired to pump cement or other slurry down the tubing and force the slurry out into a formation. It thus becomes necessary to seal the tubing with respect to the well casing and to prevent the fluid pressure of the slurry from lifting the tubing out of the well. Downhole tools referred to as packers and bridge plugs are designed for these general purposes and are well known in the art of producing oil and gas.

The EZ Drill SV® squeeze packer, for example includes a set ring housing, upper slip wedge, lower slip wedge, and lower slip support made of soft cast iron. These components are mounted on a mandrel made of medium hardness cast iron. The EZ Drill® squeeze packer is similarly constructed. The Halliburton EZ Drill® bridge plug is also similar, except that it does not provide for fluid flow therethrough.

All of the above-mentioned packers are disclosed in Halliburton Services—Sales and Service Catalog No. 43, pages 2561-2562, and the bridge plug is disclosed in the same catalog on pages 2556-2557.

The EZ Drill® packer and bridge plug and the EZ Drill SV® packer are designed for fast removal from the well bore by either rotary or cable tool drilling methods. Many of the components in these drillable packing devices are locked together to prevent their spinning while being drilled, and the harder slips are grooved so that they will be broken up in small pieces. Typically, standard "tri-cone" rotary drill bits are used which are rotated at speeds of about 75 to about 120 rpm. A load of about 5,000 to about 7,000 pounds of weight is applied to the bit for initial drilling and increased as necessary to drill out the remainder of the packer or bridge plug, depending upon its size. Drill collars may be used as required for weight and bit stabilization.

Such drillable devices have worked well and provide improved operating performance at relatively high temperatures and pressures. The packers and bridge plugs mentioned above are designed to withstand pressures of about 10,000 psi (700 kg/cm$^2$) and temperatures of about 425° F. (220° C.) after being set in the well bore. Such pressures and temperatures require using the cast iron components previously discussed.

However, drilling out iron components requires certain techniques. Ideally, the operator employs variations in rotary speed and bit weight to help break up the metal parts and reestablish bit penetration should bit penetration cease while drilling. A phenomenon known as "bit tracking" can occur, wherein the drill bit stays on one path and no longer cuts into the downhole tool. When this happens, it is necessary to pick up the bit above the drilling surface and rapidly recontact the bit with the packer or plug and apply weight while continuing rotation. This aids in breaking up the established bit pattern and helps to reestablish bit penetration. If this procedure is used, there are rarely problems. However, operators may not apply these techniques or even recognize when bit tracking has occurred. The result is that drilling times are greatly increased because the bit merely wears against the surface of the downhole tool rather than cutting into it to break it up.

In order to overcome the above long standing problems, the assignee of the present invention introduced to the industry a line of drillable packers and bridge plugs currently marketed by the assignee under the trademark FAS DRILL®. The FAS DRILL® line of tools consists of a majority of the components being made of non-metallic engineering grade plastics to greatly improve the drillability of such downhole tools. The FAS DRILL® line of tools has been very successful and a number of U.S. patents have been issued to the assignee of the present invention, including U.S. Pat. No. 5,271,468 to Streich et al., U.S. Pat. No. 5,224,540 to Streich et al., U.S. Pat. No. 5,390,737 to Jacobi et al., U.S. Pat. No. 5,540,279 to Branch et al., U.S. Pat. No. 5,701,959 to Hushbeck et al., U.S. Pat. No. 5,839,515 to Yuan et al., and U.S. Pat. No. 5,984,007 to Yuan et al. The preceding patents are specifically incorporated herein by reference.

The tools described in all of the above references typically make use of metallic or non-metallic slip-elements, or slips, that are initially retained in close proximity to the mandrel but are forced outwardly away from the mandrel of the tool to engage a casing previously installed within the wellbore in which operations are to be conducted upon the tool being set. Thus, upon the tool being positioned at the desired depth, the slips are forced outwardly against the wellbore to secure the packer, or bridge plug as the case may be, so that the tool will not move relative to the casing when for example operations are being conducted for tests, to stimulate production of the well, or to plug all or a portion of the well.

The FAS DRILLS® line of tools includes a frac plug which is well known in the industry. A frac plug is essentially a downhole packer with a ball seat for receiving a sealing ball. When the packer is set and the sealing ball engages the ball seat, the casing or other pipe in which the frac plug is set is sealed. Fluid, such as a slurry, can be pumped into the well after the sealing ball engages the seat and forced into a formation above the frac plug. Prior to the seating of the ball, however, flow through the frac plug is allowed.

One way to seal the frac plug is to drop the sealing ball from the surface after the packer is set. Although ultimately the ball will reach the ball seat and the frac plug will perform its desired function, it takes time for the sealing ball to reach the ball seat, and as the ball is pumped downwardly a substantial amount of fluid can be lost through the frac plug.

The ball may also be run into the well with the packer. Fluid loss and lost time to get the ball seated can still be a problem, however, especially in deviated wells. Some wells are deviated to such an extent that even though the ball is run into the well with the packer, the sealing ball can drift away from the packer as it is lowered into the well through the deviated portions thereof. As is well known, some wells deviate such that they become horizontal or at some portions may even angle slightly upwardly. In those cases, the sealing ball can be separated from the packer a great distance in the well. Thus, a large amount of fluid and time is taken to get the sealing ball moved to the ball seat, so that the frac plug seals the well to prevent flow therethrough. Thus, while standard frac plugs work well, there is a need for a frac plug which will allow for flow therethrough until it is set in the well and the sealing ball engages the ball seat, but that can be set with a minimal amount of fluid loss and loss of time. The present invention meets that need.

Another object of the present invention is to provide a downhole tool that will not spin as it is drilled out. When the drillable tools described herein are drilled out, the lower portion of the tool being drilled out will be displaced downwardly in the well once the upper portion of the tool is drilled through. If there is another tool in the well therebelow, the portion of the partially drilled tool will be displaced downwardly in the well and will engage the tool therebelow. As the drill is lowered into the well and engages the portion of the tool that has dropped in the well, that portion of the tool sometimes has a tendency to spin and thus can take longer than is desired to drill out. Thus, there is a need for a downhole tool which will not spin when an undrilled portion of that tool engages another tool in the well as it is being drilled out of the well.

SUMMARY OF THE INVENTION

The present invention provides a downhole tool for sealing a wellbore. The downhole tool comprises a frac plug which comprises a packer having a ball seat defined therein and a sealing ball for engaging the ball seat. The packer has an upper end, a lower end and a longitudinal flow passage therethrough. The frac plug of the present invention also has a ball cage disposed at the upper end of the packer. The sealing ball is disposed in the ball cage and thus is prevented from moving past a predetermined distance away from the ball seat. The packer includes a packer mandrel having an upper and lower end, and has an inner surface that defines the longitudinal flow passage. The ball seat is defined by the mandrel, and more particularly by the inner surface thereof.

A spring may be disposed in the mandrel and has an upper end that engages the sealing ball. The spring has a spring force such that it will keep the sealing ball from engaging the ball seat until a predetermined flow in the well is achieved. Once the predetermined flow rate is reached, the sealing ball will compress the spring and will engage the ball seat to close the longitudinal flow passage. Flow downwardly through the longitudinal flow passage is prevented when the sealing ball engages the ball seat. The present invention may be used with or without the spring.

The packer includes slips and a sealing element disposed about the mandrel such that when it is set in the wellbore and when the sealing ball is engaged with the ball seat, no flow past the frac plug is allowed. A slurry or other fluid may thus be directed into the formation above the frac plug. The ball cage has a plurality of flow ports therein so that fluid may pass therethrough into the longitudinal central opening thus allowing for fluid flow through the frac plug when the packer is set but the sealing ball has not engaged the ball seat. Fluid can flow through the frac plug so long as the flow rate is below the rate which will overcome the spring force and cause the sealing ball to engage the ball seat. Thus, one object of the present invention is to provide a frac plug which allows for flow therethrough but which alleviates the amount of fluid loss and loss of time normally required for seating a ball on the ball seat of a frac plug. Additional objects and advantages of the invention will become apparent as the following detailed description of the preferred embodiment is read in conjunction with the drawings which illustrate such preferred embodiment.

DESCRIPTION OF A PREFERRED EMBODIMENT

Figure 1A:
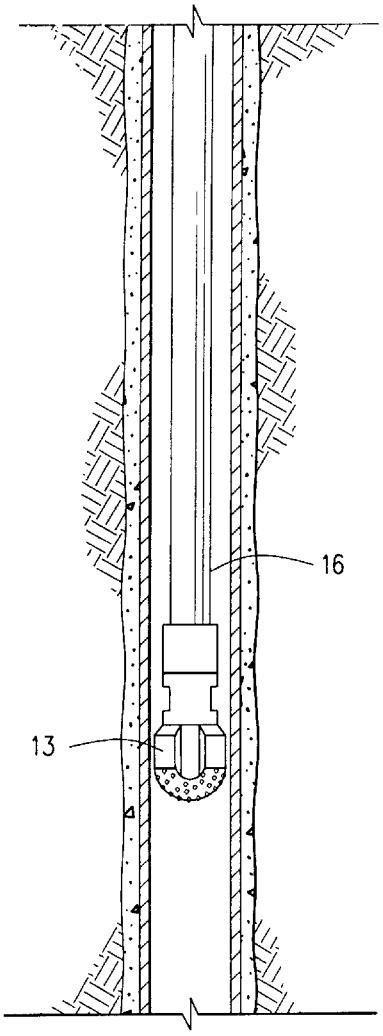
FIGS. 1A and 1B schematically show two downhole tools of the present invention positioned in a wellbore with a drill bit disposed thereabove.

In the description that follows, like parts are marked throughout the specification and drawings with the same reference numerals, respectively. The drawings are not necessarily to scale and the proportions of certain parts have been exaggerated to better illustrate details and features of the invention. In the following description, the terms "upper," "upward," "lower," "below," "downhole" and the like as used herein shall mean in relation to the bottom or furthest extent of the surrounding wellbore even though the well or portions of it may be deviated or horizontal. The terms "inwardly" and "outwardly" are directions toward and away from, respectively, the geometric center of a referenced object. Where components of relatively well known designs are employed, their structure and operation will not be described in detail.

Figure 1B:
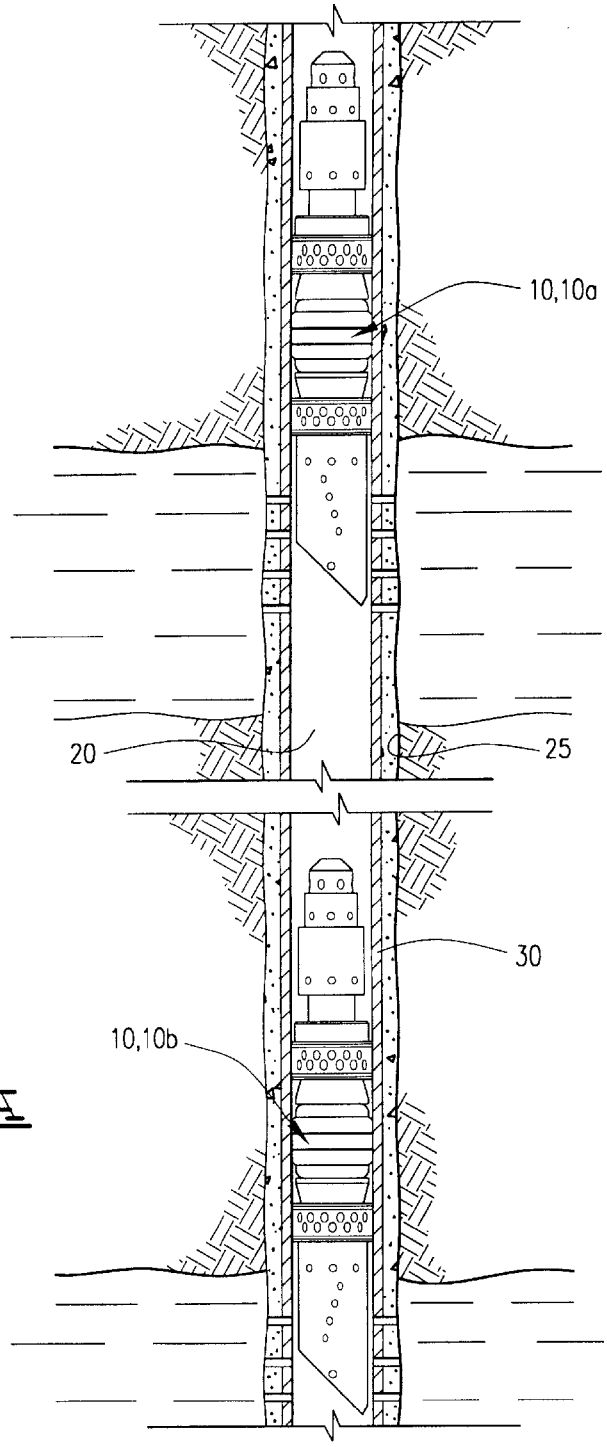

Referring now to the drawings, and more specifically to FIG. 1, the downhole tool or frac plug of the present invention is shown and designated by the numeral 10. Frac plug 10 has an upper end 12 and a lower end 14. In FIG. 1, two frac plugs 10 are shown and may be referred to herein as an upper downhole tool or frac plug 10*a* and a lower downhole tool or frac plug 10*b*. Frac plugs 10 are schematically shown in FIG. 1 in a set position 15. The frac plugs 10 shown in FIG. 1 are shown after having been lowered into a well 20 with a setting tool of any type known in the art. Well 20 comprises a wellbore 25 having a casing 30 set therein.

Figure 2:
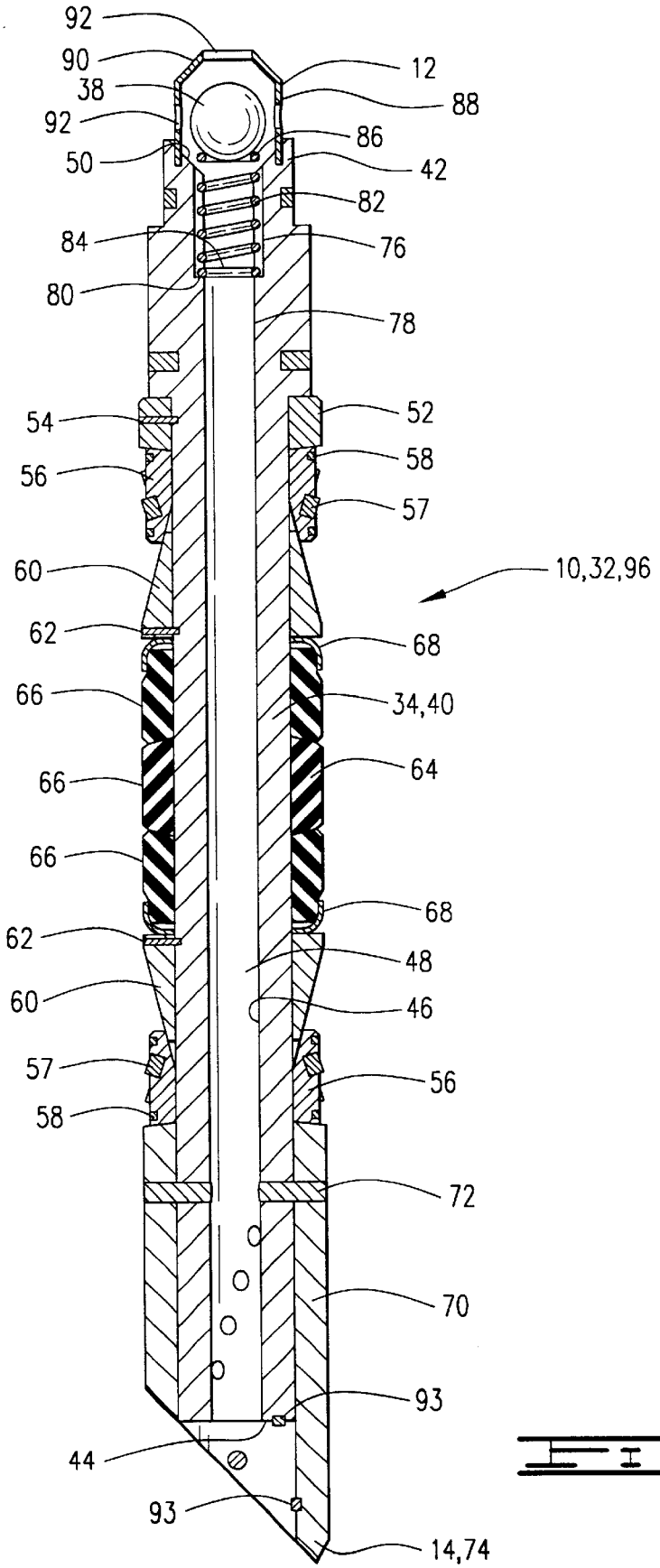
FIG. 2 shows a cross-section of the frac plug of the present invention.

Referring now to FIG. 2, a cross-section of the frac plug 10 is shown in an unset position 32. The tool shown in FIG. 2 is referred to as a frac plug since it will be utilized to seal the wellbore to prevent flow past the frac plug. The frac plug disposed herein may be deployed in wellbores having casings or other such annular structure or geometry in which the tool may be set. As is apparent, the overall downhole tool structure is like that typically referred to as a packer, which typically has at least one means for allowing fluid communication through the tool. Frac plug 10 thus may be said to comprise a packer 34 having a ball cage or ball cap 36 extending from the upper end thereof. A sealing ball 38 is disposed or housed in ball cage 36. Packer 34 comprises a mandrel 40 having an upper end 42, a lower end 44, and an inner surface 46 defining a longitudinal central flow passage 48. Mandrel 40 defines a ball seat 50. Ball seat 50 is preferably defined at the upper end 42 of mandrel 40.

Packer 34 includes spacer rings 52 secured to mandrel 40 with pins 54. Spacer ring 52 provides an abutment which serves to axially retain slip segments 56 which are positioned circumferentially about mandrel 40. Slip segments 56 may utilize ceramic buttons 57 as described in detail in U.S. Pat. No. 5,984,007. Slip retaining bands 58 serve to radially retain slip segments 56 in an initial circumferential position about mandrel 40 as well as slip wedge 60. Bands 58 are made of a steel wire, a plastic material, or a composite material having the requisite characteristics of having sufficient strength to hold the slip segments 56 in place prior to actually setting the downhole tool 10 and to be easily drillable when the downhole tool 10 is to be removed from the wellbore 25. Preferably, bands 58 are an inexpensive and easily installed about slip segments 56. Slip wedge 60 is initially positioned in a slidable relationship to, and partially underneath slip segment 56. Slip wedge 60 is shown pinned into place by pins 62. Located below slip wedge 60 is at least one packer element, and as shown in FIG. 2, a packer element assembly 64 consisting of three expandable packer elements 66 disposed about packer mandrel 40. Packer shoes 68 are disposed at the upper and lower ends of packer element assembly 64 and provide axial support thereto. The particular packer seal or element arrangement shown in FIG. 2 is merely representative as there are several packer element arrangements known and used within the art.

Located below a lower slip wedge 60 are a plurality of slip segments 56. A mule shoe 70 is secured to mandrel 40 by radially oriented pins 72. Mule shoe 70 extends below the lower end 44 of packer 40 and has a lower end 74, which comprises lower end 14 of downhole tool 10. The lower most portion of downhole tool 10 need not be a mule shoe 70 but could be any type of section which serves to terminate the structure of downhole tool 10 or serves to be a connector for connecting downhole tool 10 with other tools, a valve, tubing or other downhole equipment.

Referring back to the upper end of FIG. 2, inner surface 46 defines a first diameter 76, a second diameter 78 displaced radially inwardly therefrom, and a shoulder 80 which is defined by and extends between first and second diameters 76 and 78, respectively. A spring 82 is disposed in mandrel 40. Spring 82 has a lower end 84 and an upper end 86. Lower end 84 engages shoulder 80. Sealing ball 38 rests on the upper end 86 of spring 82.

Ball cage or ball cap 36 comprises a body portion 88 having an upper end cap 90 connected thereto, and has a plurality of ports 92 therethrough. Referring now to the lower end of FIG. 2, a plurality of ceramic buttons 93 are disposed at or near the lower end 74 of downhole tool 10 and at the lower end 44 of mandrel 40. As will be described in more detail hereinbelow, the ceramic buttons 93 are designed to engage and grip tools positioned in the well therebelow to prevent spinning when the tools are being drilled out.

Figure 3:
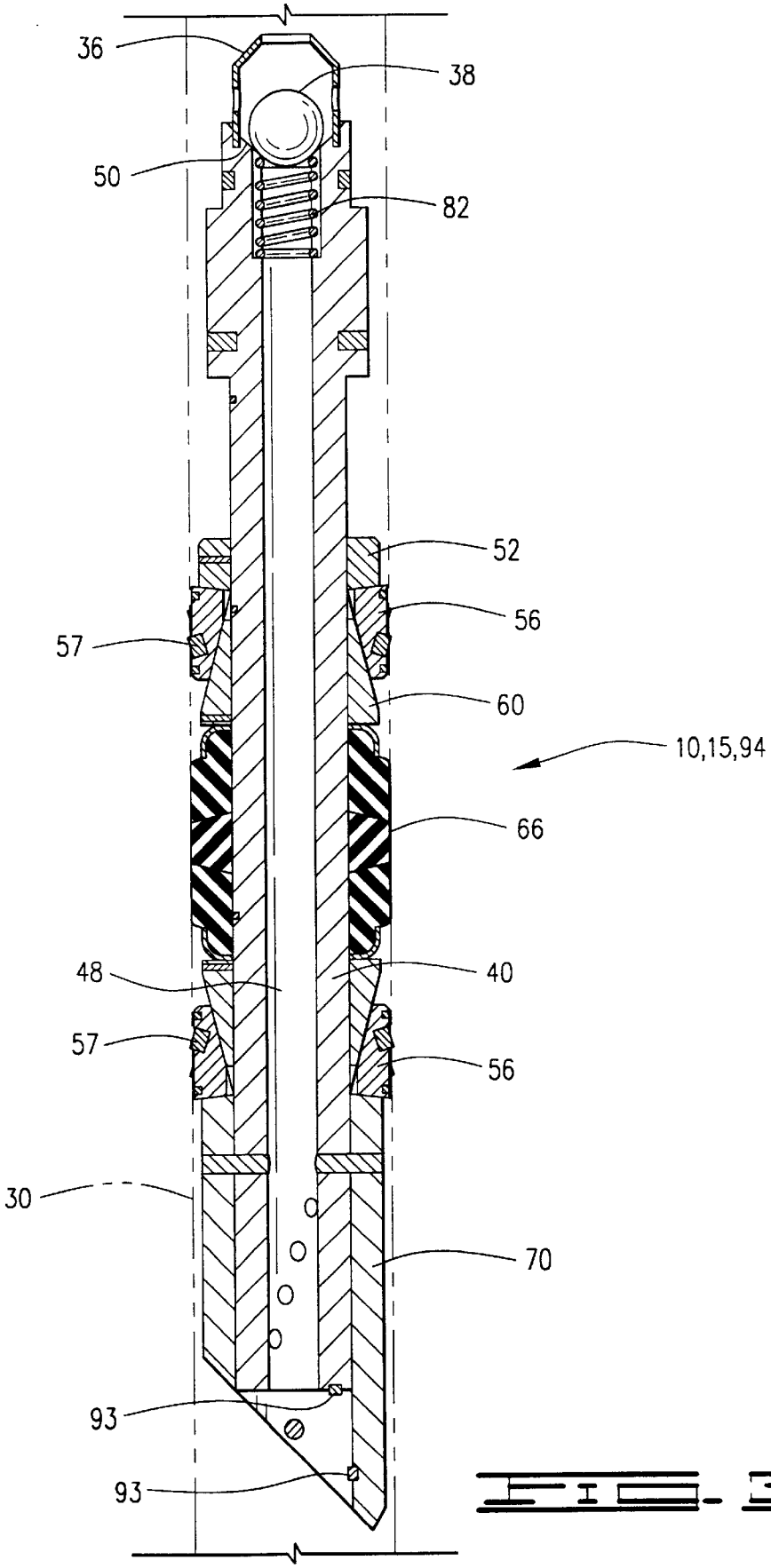
FIG. 3 is a cross-sectional view of the frac plug of the present invention in the set position with the slips and the sealing element expanded to engage casing or other pipe in the wellbore.
Figure 4:
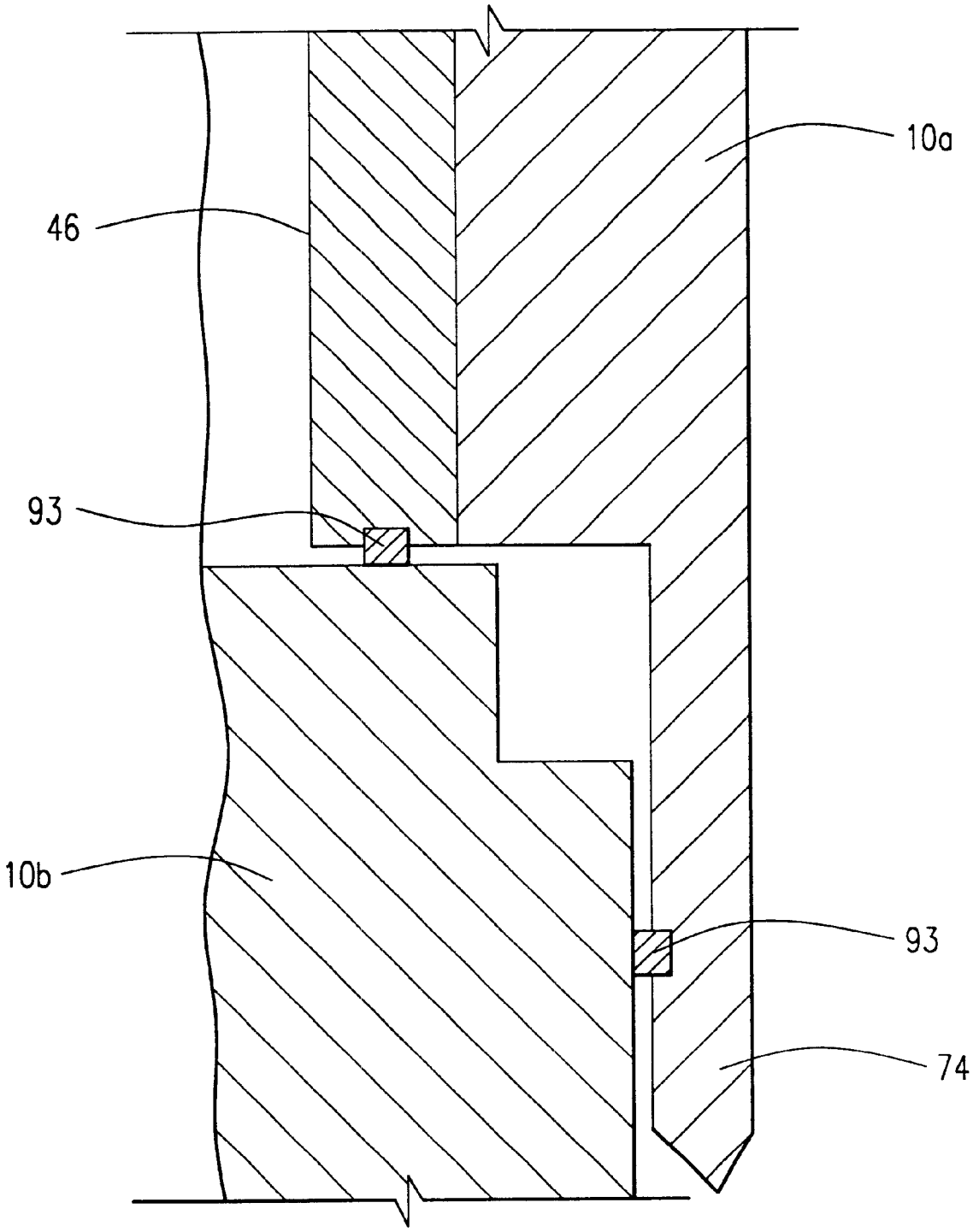
FIG. 4 shows a lower end of the frac plug of the present invention engaging the upper end of a second tool.

The operation of frac plug 10 is as follows. Frac plug 10 may be lowered into the wellbore 25 utilizing a setting tool of a type known in the art. As is depicted schematically in FIG. 1, one, two or several frac plugs or downhole tools 10 may be set in the hole. As the frac plug 10 is lowered into the hole, flow therethrough will be allowed since the spring 82 will prevent sealing ball 38 from engaging ball seat 50, while ball cage 36 prevents sealing ball 38 from moving away from ball seat 50 any further than upper end cap 90 will allow. Once frac plug 10 has been lowered to a desired position in the well 20, a setting tool of a type known in the art can be utilized to move the frac plug 10 from its unset position 32 to the set position 15 as depicted in FIGS. 2 and 3, respectively. In set position 15 slip segments 56 and expandable packer elements 66 engage casing 30. It may be desirable or necessary in certain circumstances to displace fluid downward through ports 92 in ball cage 36 and thus into and through longitudinal central flow passage 48. For example, once frac plug 10 has been set it may be desirable to lower a tool into the well, such as a perforating tool, on a wire line. In deviated wells it may be necessary to move the perforating tool to the desired location with fluid flow into the well. If a sealing ball has already seated and could not be removed therefrom, or if a bridge plug was utilized, such fluid flow would not be possible and the perforating or other tool would have to be lowered by other means.

When it is desired to seat sealing ball 38, fluid is displaced into the well at a predetermined flow rate which will overcome a spring force of the spring 82. The flow of fluid at the predetermined rate or higher will cause sealing ball 38 to move downwardly such that it engages ball seat 50. When sealing ball 38 is engaged with ball seat 50 and the packer 34 is in its set position 15, fluid flow past frac plug 10 is prevented. Thus, a slurry or other fluid may be displaced into the well 20 and forced out into a formation above frac plug 10. The position shown in FIG. 3 may be referred to as a closed position 94 since the longitudinal central flow passage 48 is closed and no flow through frac plug 10 is permitted. The position shown in FIG. 2 may therefore be referred to as an open position 96 since fluid flow through the frac plug 10 is permitted when the sealing ball 38 has not engaged ball seat 50. As is apparent, sealing ball 38 is trapped in ball cage 36 and is thus prevented from moving upwardly relative to the ball seat 50 past a predetermined distance, which is determined by the length of the ball cage 36. The spring 82 acts to keep the sealing ball 38 off of the ball seat 50 such that flow is permitted until the predetermined flow rate is reached. Ball cage 36 thus comprises a retaining means for sealing ball 38, and carries sealing ball 38 with and as part of frac plug 10, and also comprises a means for preventing sealing ball 38 from moving upwardly past a predetermined distance away from ball seat 50.

When it is desired to drill frac plug 10 out of the well, any means known in the art may be used to do so. Once the drill bit 13 connected to the end of a tool string or tubing string 16 has gone through a portion of the frac plug 10, namely the slip segments 56 and the expandable packer elements 66, at least a portion of the frac plug 10, namely the lower end 14 which in the embodiment shown will include the mule shoe 70, will fall into or will be pushed into the well 20 by the drill bit 13. Assuming there are no other tools therebelow, that portion of the frac plug 10 may be left in the hole. However, as shown in FIG. 1, there may be one or more tools below the frac plug 10. Thus, in the embodiment shown, ceramic buttons 93 in the upper frac plug 10*a* will engage the upper end 12 of lower frac plug 10*b* such that the portion of upper frac plug 10*a* will not spin as it is drilled from the well 20. Although frac plugs 10 are utilized in the foregoing description, the ceramic buttons 93 may be utilized with any downhole tool such that spinning relative to the tool therebelow is prevented.

Although the invention has been described with reference to a specific embodiment, the foregoing description is not intended to be construed in a limiting sense. Various modifications as well as alternative applications will be suggested to persons skilled in the art by the foregoing specification and illustrations. It is therefore contemplated that the appended claims will cover any such modifications, applications or embodiments as followed in the true scope of this invention.

What is claimed is:

1. A downhole apparatus for use in a well, the apparatus comprising:

a mandrel having an upper end and a lower end, said mandrel defining a longitudinal central opening for allowing flow therethrough, said mandrel defining a ball seat;

a sealing element disposed about said mandrel for sealingly engaging the well;

an upper end cap disposed above said ball seat;

a ball cage connected to said upper end of said mandrel, said ball cage having a body portion extending upwardly from said upper end of said mandrel, said upper end cap being connected to said body portion of said ball cage, wherein said ball cage defines flow ports for permitting flow therethrough into said longitudinal central opening; and a sealing ball trapped between said upper end cap and said ball seat for sealingly engaging said ball seat.

2. The downhole apparatus of claim 1, wherein said downhole apparatus may be alternated between an open and a closed position, wherein in said closed position said sealing ball engages said ball seat to prevent fluid flow downwardly through said longitudinal central opening, and wherein in said open position said sealing ball is disengaged from said ball seat to allow fluid flow through said longitudinal central opening.

3. The downhole apparatus of claim 2, wherein said downhole apparatus moves from said open to said closed position in response to a predetermined fluid flow rate in the well.

4. The downhole apparatus of claim 1, further comprising a spring disposed in said mandrel, said spring having an upper end and a lower end, wherein said upper end engages said sealing ball and wherein said spring applies a predetermined upward spring force to said sealing ball to hold said sealing ball away from said ball seat until a predetermined flow rate in the well is achieved, wherein fluid flow in the well at a predetermined rate will overcome said spring force and will urge said sealing ball into engagement with said ball seat to prevent flow downwardly through said longitudinal central opening.

5. The downhole apparatus of claim 1, wherein said downhole apparatus may be alternated between an open and a closed position, wherein in said open position said sealing ball is housed in said ball cage and flow through said longitudinal central opening is permitted, and wherein in said closed position said sealing ball engages said ball seat to prevent flow downwardly through said longitudinal central opening.

6. A frac plug for use in a well, the frac plug comprising:

a mandrel defining a longitudinal flow passage;

an expandable sealing element disposed about said mandrel;

a ball seat defined on said mandrel for receiving a sealing ball;

a sealing ball positioned above said ball seat for engaging said ball seat and closing said longitudinal flow passage; and a ball cage connected to said mandrel for restricting upward movement of said sealing ball relative to said ball seat so that said sealing ball is prevented from moving upwardly past a predetermined distance from said ball seat, said ball cage having a plurality of ports for allowing flow therethrough into said longitudinal flow passage.

7. The frac plug of claim 6, said frac plug having an open position wherein fluid may be displaced through said ball cage and through said longitudinal flow passage, and a closed position wherein said sealing ball engages said ball seat to prevent flow downwardly through said longitudinal flow passage so that flow past said frac plug is prevented when said frac plug is in said closed position.

8. The frac plug of claim 7, wherein said sealing ball is positioned in said ball cage when said frac plug is in said open position.

9. The frac plug of claim 7, further comprising a spring disposed in said longitudinal flow passage, wherein an upper end of said spring engages said sealing ball to hold said sealing ball away from said ball seat when said frac plug is in said open position.

10. The frac plug of claim 7, wherein said frac plug may be moved from its open to its closed position by displacing fluid into the well at a rate sufficient to overcome a spring force of said spring so that said sealing ball is urged downwardly to engage said ball seat.

11. The frac plug of claim 6, wherein said frac plug is comprised of a drillable material.

12. The frac plug of claim 11, further comprising gripping means for gripping a downhole tool in the well positioned below said frac plug, wherein said gripping means will prevent any portion of said frac plug that falls downwardly in the well and engages the downhole tool from spinning relative thereto when said portion of said frac plug is engaged by a drill to drill said frac plug out of the well.

13. A downhole apparatus for use in a well, the apparatus comprising:

a mandrel having an upper end and a lower end, said mandrel defining a longitudinal central opening for allowing flow therethrough, said mandrel defining a ball seat;

a sealing element disposed about said mandrel for sealingly engaging the well;

an upper end cap disposed above said ball seat;

a sealing ball trapped between said upper end cap and said ball seat for sealingly engaging said ball seat; and a spring disposed in said mandrel, said spring having an upper end and a lower end, wherein said upper end of said spring engages said sealing ball and wherein said spring applies a predetermined upward spring force to said sealing ball to hold said sealing ball away from said ball seat until a predetermined flow rate in the well is achieved, wherein fluid flow in the well at a predetermined rate will overcome said spring force and will urge said sealing ball into engagement with said ball seat to prevent flow downwardly through said longitudinal central opening.

* * * * *